United States Patent [19]

Skaalen

[11] 4,143,440

[45] Mar. 13, 1979

[54] PIN CONNECTION SYSTEM FOR ELEVATED CAUSEWAYS

[75] Inventor: Clifford I. Skaalen, Oxnard, Calif.

[73] Assignee: The United States of America as represented by the Secretary of the Navy, Washington, D.C.

[21] Appl. No.: 891,772

[22] Filed: Mar. 30, 1978

[51] Int. Cl.[2] ..... E01D 19/02

[52] U.S. Cl. ..... 14/77; 211/208; 182/146; 52/745; 405/231

[58] Field of Search ..... 14/77, 1; 248/354 P, 248/219.2, 219.3; 211/207, 208; 182/146; 52/745; 61/53, 54

[56] References Cited

U.S. PATENT DOCUMENTS

| | | | |
|---|---|---|---|
| 1,070,910 | 8/1913 | Nichols | 182/146 X |
| 1,541,971 | 6/1925 | Lampert | 248/354 P |
| 2,368,385 | 1/1945 | Symons | 248/354 P |
| 2,675,256 | 4/1954 | Cornell | 248/354 P X |
| 2,775,869 | 1/1957 | Pointer | 61/91 |
| 3,870,268 | 3/1975 | Larkin | 248/354 P |

FOREIGN PATENT DOCUMENTS

| | | | |
|---|---|---|---|
| 166099 | 6/1950 | Austria | 248/354 P |
| 2709085 | 9/1977 | Fed. Rep. of Germany | 248/354 P |
| 369732 | 3/1932 | United Kingdom | 248/354 P |
| 778624 | 7/1957 | United Kingdom | 248/354 P |

*Primary Examiner*—Nile C. Byers, Jr.

*Attorney, Agent, or Firm*—Richard S. Sciascia; Joseph M. St. Amand; Darrell E. Hollis

[57] ABSTRACT

A pin connection system supporting a causeway section from a pipe piling comprising an elongated body member adapted for insertion through a pair of diametrically opposed openings in the pipe piling. One end of the body member having a guide tip rigidly affixed thereto and the other end having a retrieval shackle rotatably affixed thereto. A pair of safety stops are rigidly affixed to the underside of the pin for straddling the inside and outside diameter surfaces of the pipe piling adjacent one of the openings. A skid plate is inserted through the openings prior to the insertion of the pin thereby providing a guide for the pin insertion.

9 Claims, 7 Drawing Figures

PIN CONNECTION SYSTEM FOR ELEVATED CAUSEWAYS

BACKGROUND OF THE INVENTION

1. Field of the Invention

The present invention relates generally to pin connection systems for elevated causeways, and more particularly to such systems having safety stops attached thereto.

2. Description of the Prior Art

The old method of connecting causeways to pipe pilings was to weld the causeway sections to the pipe piling using steel gusset plates. The welding procedures required many welders, welding machines, as well as miscellaneous support equipment. The welding process was very time-consuming requiring the use of a temporary connection system so that jacks could be removed before the permanent weldable connection was installed. In addition, the welded connection ws too rigid a connection for the flexible pier system and could not be reused. Also, removal of the welded connection was time-consuming and required substantial additional support equipment.

In contradistinction, the present invention can be quickly installed by two men and can be easily removed and reused. No threaded fasteners or other complex mechanisms which may be damaged by salt water are required for load transfer as is the case in prior art devices utilizing tensile members.

SUMMARY OF THE INVENTION

The present invention overcomes the disadvantages and limitations of the prior art by providing an improved causeway pin connection system. The present invention utilizes a pin having an elongated body with a guide tip attached to one end and a retrieval shackle to the other end. In addition, the pin has a pair of safety stops attached to the underside thereof.

It is therefore an object of the present invention to provide an improved pin connection system for elevated causeways.

It is also an object of the present invention to increase reliability and decrease cost.

Another object of the present invention is to provide a pin connection system that can be easily and quickly installed and easily and quickly removed and reused.

Other objects and further scope of applicability of the present invention will become apparent from the detailed description given hereinafter. The detailed description indicates the preferred embodiments of the invention and is given by way of illustration only since various changes and modifications within the spirit and scope of the invention will become apparent to those skilled in the art from this detailed description.

DETAILED DESCRIPTION OF THE PREFERRED EMBODIMENTS

Figure 1:
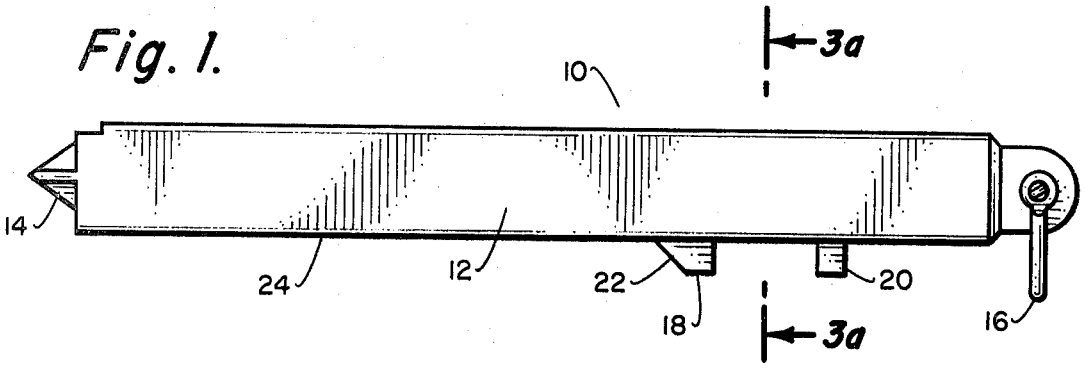
FIG. 1 is a side view of one embodiment of the present invention.

FIG. 1 is a side view of a pin 10 utilized to support a causeway section. The pin 10 has an elongated body section or member 12 which is fabricated from steel or other material capable of maintaining its physical integrity while supporting a causeway section. A guide tip 14 is rigidly affixed to one end of elongated body member 12 while a retrieval shackle 16 is rotatably affixed to the other end of elongated body member 12. A pair of safety stops 18 and 20 are rigidly affixed to the underside of elongated body member 12. Safety stop 18 incorporates a sloped surface 22 adjoining underside surface 24 of elongated body member 12. The sloped surface 22 facilitates the insertion of pin 10 i.e., safety stop 18 is not as likely to catch on a surface with sloped surface 22 incorporated therein as would be the case if the surface were perpendicular to underside surface 24.

Figure 3A:
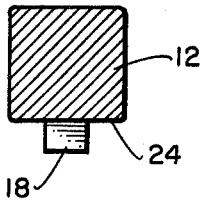
FIGS. 3*a* and 3*b* are cross sectional views of the embodiment of FIG. 1 taken along line 3*a*.
Figure 3B:
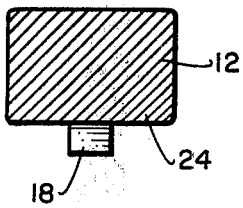

Now turning to FIGS. 3*a* and 3*b*, a cross section taken along line 3*a* of FIG. 1 is illustrated. It is noted that the cross section of elongated body member 12 of FIG. 1 is substantially square shaped as shown in FIG. 3*a*. Alternatively, the cross section of body member 12 of FIG. 1 may be substantially rectangular in shape as shown in FIG. 3*b*. Of course, the cross section of elongated body member 12 may be any shape that is required for a specific application.

Figure 2:
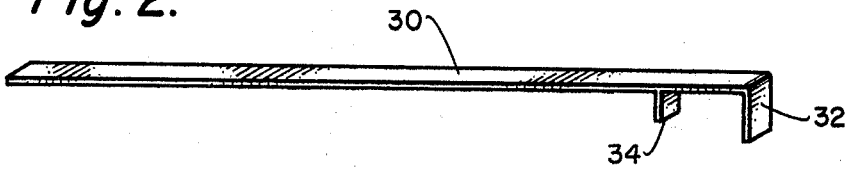
FIG. 2 is an isometric view of the skid plate.

FIG. 2 is an isometric view of a skid plate 30. Skid plate 30 is a flat piece of material having a handle 32 and a stop 34 rigidly attached thereto.

Figure 6:
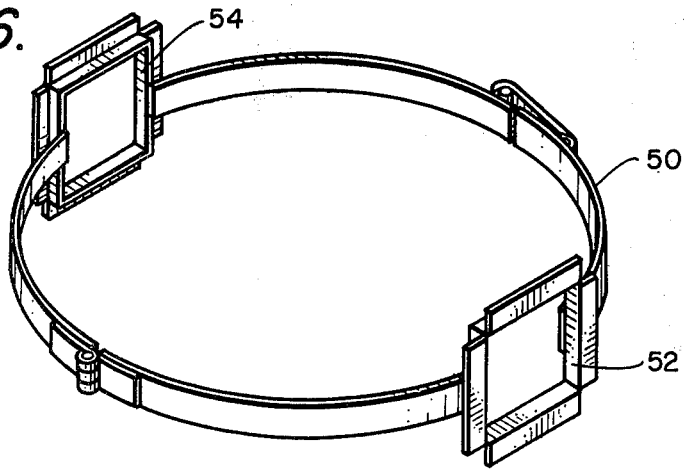
FIG. 6 illustrates a template utilized for forming openings in the pipe piling.
Figure 4:
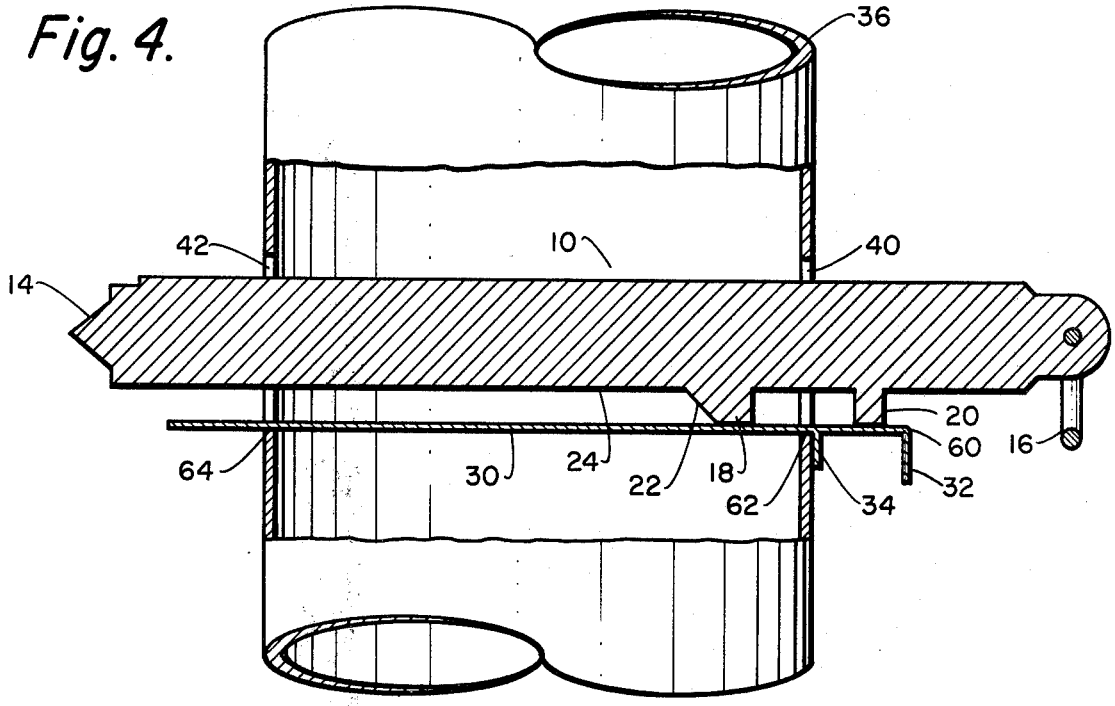
FIG. 4 illustrates the insertion of the embodiment of FIG. 1 through a pipe piling.

Now turning to FIG. 4, the pin system is illustrated showing skid plate 30 and pin 10 inserted through pipe piling 36. Pipe piling 36 contains two diametrically-opposed openings 40 and 42 through which skid plate 30 and pin 10 are inserted. The template 50 illustrated in FIG. 6 is placed around the outer surface of pipe piling 36. Openings are then cut into either side of pipe piling 36 in the shape of windows 52 and 54 of template 50 thereby providing the diametrically-opposed openings 40 and 42 contained in pipe piling 36. Next, skid plate 30 is inserted through pipe piling 36 within openings 40 and 42 until stop 34 abuts the outer surface of pipe piling 36. The handle 32 rigidly affixed to skid plate 30 provides for ease of insertion. Next, pin 10 is inserted through pipe piling 36 via holes 40 and 42. Pin 10 rides on or is supported by skid plate 30 during insertion. It is noted that inclined surface 22 of stop 18 enables stop 18 to slide over surface 60 of skid plate 30 with ease. Once pin 10 is inserted through openings 40 and 42, skid plate 30 is removed resulting in pin 10 resting on surfaces 62 and 64 of openings 40 and 42, respectively. Once skid plate 30 is removed, safety stops 18 and 20 straddle the inside and outside diameter surfaces of pipe piling 36 adjacent opening 42 and surface 62. Thus, safety stops 18 and 20 prevent pin 10 from falling out or otherwise being removed from openings 40 and 42 until causeway section 70 is lifted therefrom.

It is envisioned that pin 10 may be upwards of four feet in length and 100 pounds in weight. Due to the weight and the center of gravity of pin 10, a human inserting pin 10 may find he is unable to maintain pin 10 in a vertical position for a time sufficient to insert pin 10 through openings 40 and 42 without the use of skid plate 30. Thus, skid plate 30 provides a surface upon which pin 10 may be manually inserted through pipe piling 36 thereby preventing pin 10 from falling to the bottom of pipe piling 36.

Figure 5:
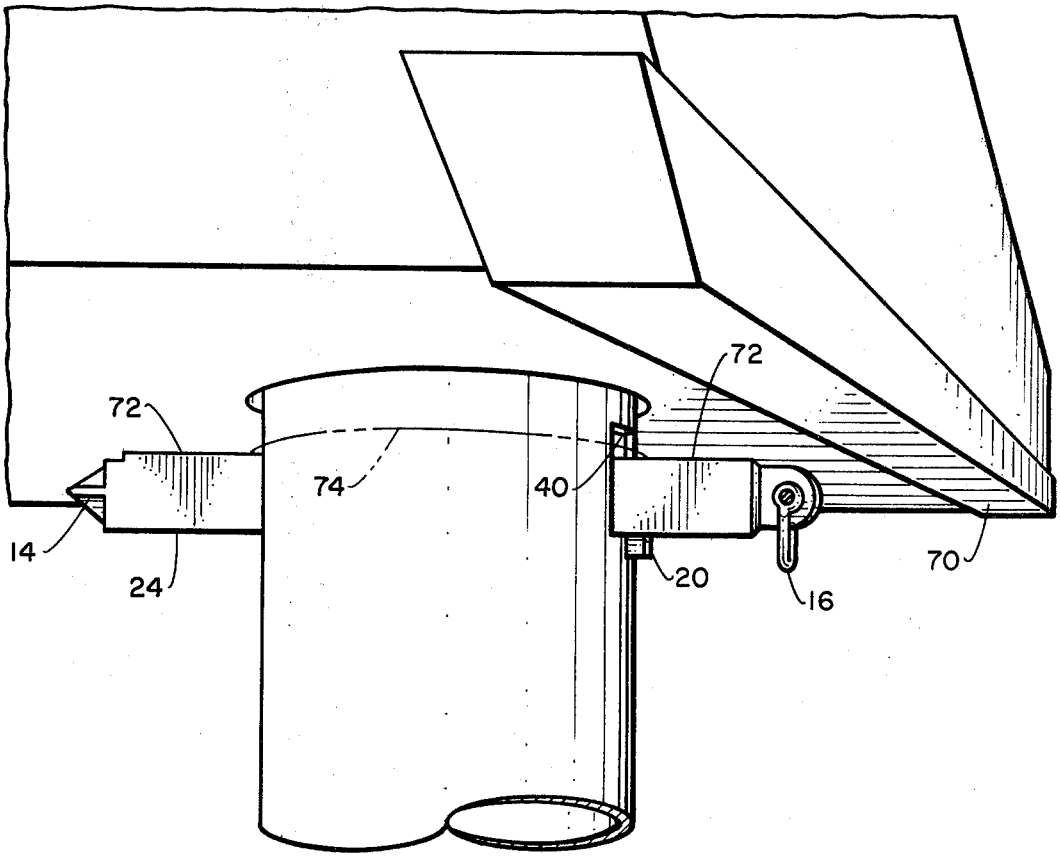
FIG. 5 illustrates a causeway section with respect to the embodiment of FIG. 1.

FIG. 5 illustrates a causeway section 70 prior to being lowered upon the upper surface 72 of pin 10. Skid plate 30 has been removed from the openings 40 and 42 in FIG. 5. Once lowered, causeway section 70 will rest on upper surface 72 of pin 10 as is illustrated by the dotted line 74 in FIG. 5.

Therefore many modifications and embodiments of this specific invention will readily come to mind to one skilled in the art having the benefit of the teachings presented in the foregoing description and accompanying drawings of the subject invention and hence it is to be understood that the invention is not limited thereto and that such modifications, etc., are intended to be included in the scope of the appended claims.

What is claimed is:

1. A method for providing support to elevated causeway sections from pipe pilings comprising:

a. providing a pair of diametrically-opposed openings in said pipe piling;

b. inserting a flat, elongated skid plate through said openings;

c. inserting a pin through said openings such that said pin extends outward from said pipe piling from each said opening, said skid plate guiding said pin during insertion;

d. removing said skid plate from said pipe piling openings; and e. lowering said causeway section upon said inserted pin.

2. The method of claim 1 wherein said diametrically-opposed openings are substantially rectangular in shape.

3. The method of claim 1 wherein the step of providing includes:

a. emplacement of a template outlining said openings adjacent said pipe piling; and b. cutting said openings in said pipe piling following the outline of said template.

4. As a new article of manufacture a pin for supporting a causeway section from a pipe piling comprising:

a. an elongated body member adapted for insertion through a pair of diametrically-opposed openings in said pipe piling; and b. a pair of safety stops rigidly affixed to said elongated body, said safety stops being disposed to straddle the inside and outside diameter surface of said pipe piling adjacent only one said opening.

5. The article of claim 4 further including a pointed guide tip rigidly attached to said elongated body.

6. The article of claim 4 further including a retrieval shackle rotatably attached to said elongated body.

7. The article of claim 4 wherein said elongated body is substantially rectangular in cross section.

8. The article of claim 4 wherein said elongated body is substantially square in cross section.

9. A method for providing support to elevated causeway section from pipe pilings comprising:

a. providing a pair of diametrically-opposed openings in said pipe piling;

b. inserting a flat, elongated skid plate through said openings such that said skid plate projects outward from said pipe piling from each said opening;

c. inserting a pin through said pair of openings such that said pin projects outward from said pipe piling from each said opening, said pin slidably riding upon said skid plate during insertion;

d. removing said skid plate from said pipe piling openings; and e. lowering said causeway section upon said inserted pin.

* * * * *